United States Patent [19]
Holman

[11] 4,318,202
[45] Mar. 9, 1982

[54] CONVERSION DEVICE FOR CANNISTER VACUUM CLEANERS

[76] Inventor: Donald M. Holman, 7302 Larsen, Shawnee, Kans. 66203

[21] Appl. No.: 197,580

[22] Filed: Oct. 16, 1980

[51] Int. Cl.[3] ..... A47L 9/00
[52] U.S. Cl. ..... 15/328; 15/323; 15/354; 15/377
[58] Field of Search ..... 15/328, 323, 377, 339, 15/338, 354

[56] References Cited

U.S. PATENT DOCUMENTS

| | | | |
|---|---|---|---|
| 2,920,337 | 1/1960 | Smith | 15/323 |
| 3,039,130 | 6/1962 | Belicka et al. | 15/377 |
| 3,063,082 | 11/1962 | Rosenberg | 15/328 X |
| 3,310,828 | 3/1967 | Clark et al. | 15/328 |
| 3,358,316 | 12/1967 | Okun | 15/352 |

FOREIGN PATENT DOCUMENTS

| | | | |
|---|---|---|---|
| 648771 | 8/1937 | Fed. Rep. of Germany | 15/323 |

*Primary Examiner*—Chris K. Moore
*Attorney, Agent, or Firm*—Schmidt, Johnson, Hovey & Williams

[57] ABSTRACT

A device is provided to allow the use of a cannister vacuum cleaner in the manner of a highly-maneuverable, height-adjustable upright vacuum cleaner. The device preferably includes a mobile base having a cannister vacuum-receiving recess for releasably supporting a cannister vacuum cleaner. A power head including a beater bar, a motor for operatively driving the beater bar, and a nozzle, is attached to the base in an operational cleaning position. A conduit connects the power head to the cannister cleaner for vacuum removal of dirt or the like from a floor surface. Wheels and height-adjusting structure are provided on the base allowing adjustment of the clearance of the power head with respect to an underlying floor surface to maximize cleaning efficiency.

7 Claims, 4 Drawing Figures

CONVERSION DEVICE FOR CANNISTER VACUUM CLEANERS

BACKGROUND OF THE INVENTION

1. Field of the Invention

This invention relates to a device for readily converting a cannister vacuum cleaner into a unit having all of the advantages of an upright vacuum cleaner while retaining the desirable features of the cannister cleaner itself. More particularly, it is concerned with a conversion device including a mobile base for releasably supporting a cannister vacuum cleaner, a power head located on the base, and a conduit for connecting the cannister unit to the power head.

2. Description of the Prior Art

Previous vacuum cleaners can be classified as either a cannister-type or an upright-type. Each type of vacuum cleaner has its own peculiar advantages and disadvantages. Cannister-type vacuum cleaners have large motors and provide powerful cleaning suction. The large motor requires a correspondingly large housing, however, and this restricts the maneuverability of such a cleaner. Manufacturers addressing this problem have equipped cannister cleaners with cleaning nozzles connected to the cleaner by means of an elongated flexible hose. The nozzle and hose are maneuverable and facilitate cleaning but, as may be readily ascertained, only in an area within the length of the hose connecting the nozzle to the cleaner. Also, the nozzle has no provision for adjustment to different floor surfaces, and this is a decided disadvantage inasmuch as various kinds of carpeting and the like are encountered in use.

Upright-type cleaners generally have smaller motors than do cannister-type cleaners and the cleaning nozzle is an integral part of the cleaner. This arrangement is advantageous to the extent that a smaller, integrated cleaner is decidedly more maneuverable and may be adjusted to different types of floor surfaces. Less powerful suction produced by the smaller motor, however, reduces the cleaning efficiency of upright cleaners in comparison to cannister cleaners. So, manufacturers equip upright cleaners with beater bars driven by the motor to physically agitate the floor surface during cleaning. The physical agitation of the floor surface by the beater bar loosens dirt or the like on the floor surface for easier vacuum removal. This cleaning arrangement is still not as efficient as that of a cannister-type cleaner with its larger motor, however.

Consumers requiring a suction cleaner have heretofore been forced to choose between the high suction cleaning efficiency advantage of a cannister-type cleaner, and the maneuverability and adjustability advantages of an upright-type cleaner. In situations necessitating powerful suction, maneuverability, and adjustability features, consumers have needed to purchase and have available both cannister and upright cleaners; obviously, this is less than optimum from an economic standpoint.

A number of vacuum cleaner devices have been proposed in the past. These devices have not met the need for a cleaner combining the advantages of both upright and cannister cleaners. Patents illustrating these prior units include: U.S. Pat. Nos. 1,703,863, 1,728,021, 2,175,644, 2,210,951, 2,219,810, 2,266,075, 2,303,409, 2,310,268, 2,871,504, 3,063,082, 3,358,316, and 4,008,505.

SUMMARY OF THE INVENTION

The problems outlined above are in large measure solved by the device in accordance with this invention. That is, the conversion device hereof allows the use of a cannister vacuum cleaner with its powerful suction-producing motor in the manner of a highly maneuverable, height-adjustable upright, thus obviating the need to purchase and have available both a cannister and an upright vacuum cleaner.

The conversion device in accordance with this invention broadly includes a mobile base for operatively and releasably supporting a cannister vacuum cleaner, a power head attached to the base in a floor cleaning position, and a conduit operatively and releasably connecting the power head to a cannister vacuum cleaner seated on the base.

In preferred forms, the upper platform of the base includes a frustoconical wall extending from the base platform to a round, planar floor and secured thereto, thus defining a cannister-receiving recess. Additionally, the power head includes an elongated, axially rotatable beater bar, a motor operatively connected to the beater bar, and nozzle partially enclosing the beater bar. The nozzle defines a passageway for vacuum removal of dirt or the like from a floor surface during cleaning operation. Also, wheels are secured to the base and height-adjustment structure is provided for cooperatively adjusting the clearance of the power head relative to an underlying floor surface.

DESCRIPTION OF THE PREFERRED EMBODIMENTS

Figure 1:
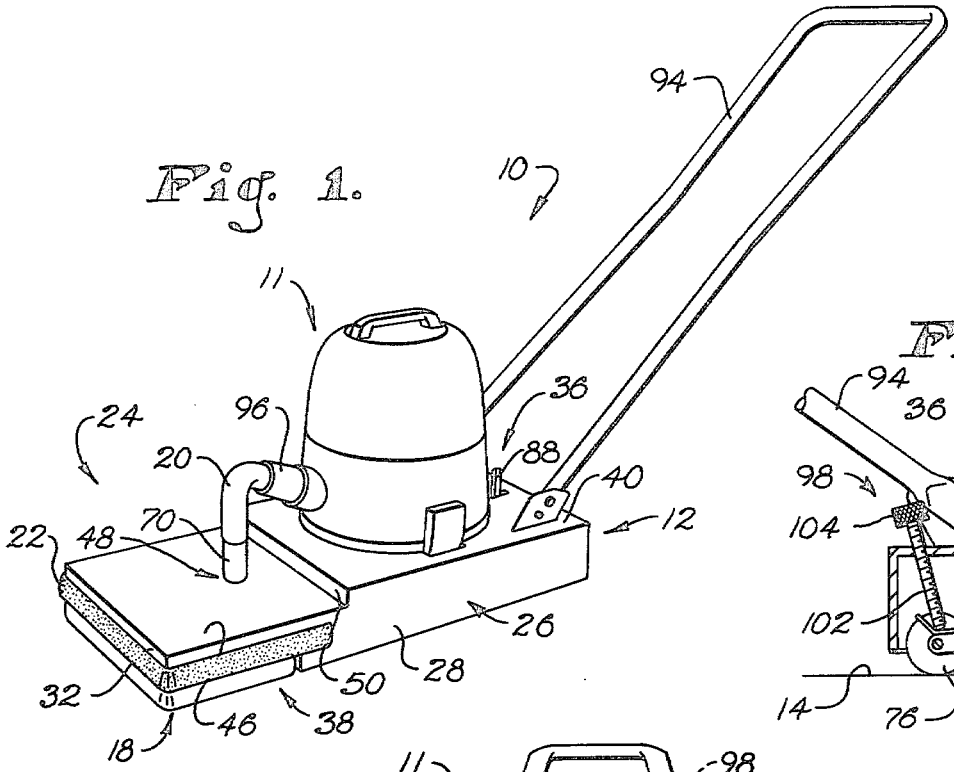
FIG. 1 is a perspective view of the preferred conversion device in accordance with the present invention.

Referring now to the drawing, a conversion device 10 for a cannister vacuum cleaner 11 is illustrated. Device 10 includes a mobile base 12, a powered cleaning device 18 mounted on mobile base 12, and a conduit 20 connecting device 18 to cleaner 11.

In more detail, mobile base 12 includes an upper platform 24 with respective, depending, planar sidewalls 28, 30, 32, 34 secured thereto and cooperatively defining a skirt 26 about the platform 24. An elastomeric bumper 22 is attached to the forward end of base 12, i.e., to walls 28, 30, and 32. Platform 24 comprises rearward cannister vacuum receiving section 36 and forward powered cleaning device section 38. The sections 36, 38 are interconnected by a vertical strip 50. Section 36 includes a rectangular planar deck 40 having a central cannister receiving recess 16 therein. Recess 16 is defined by a circular, planar floor 42 secured to a continuous, circumscribing, upstanding frustoconical wall 44. The upper edge of wall 44 is secured to deck 40, as shown. The slope of wall 44 forms an acute angle with a line perpendicular to the plane of floor 42, matching the corresponding taper of the base section of cleaner 11.

As can be readily appreciated, the diameter of floor 42 corresponds to the diameter of the base of cleaner 11.

Section 38 includes a rectangular deck 46 having a round aperture 48 located on the rear portion thereof. Device 18 is mounted under deck 46 in underlying disposition thereto, and within the space presented by walls 28, 30, and 32.

Figure 2:
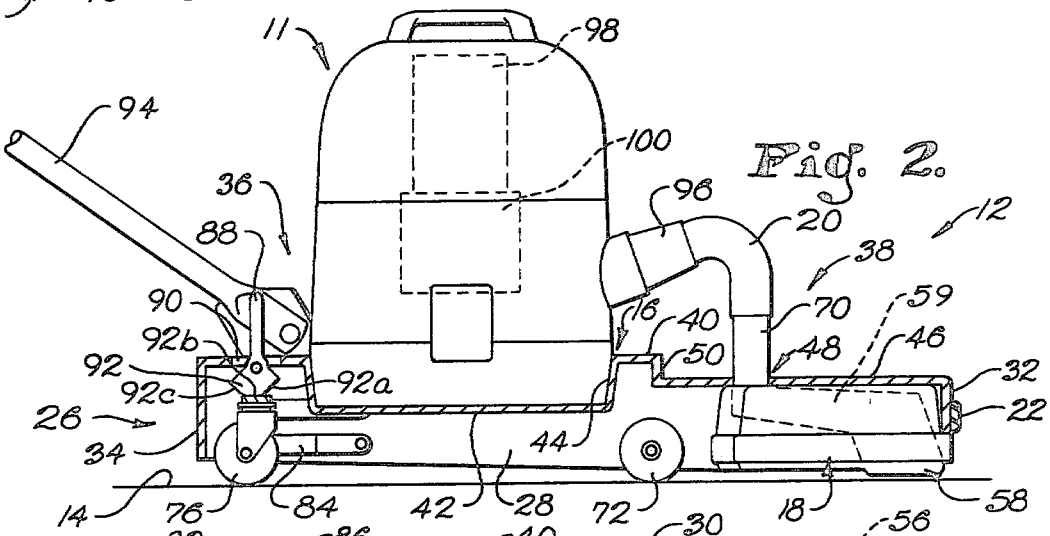
FIG. 2 is a fragmentary side view in partial vertical section which illustrates the location of a cannister vacuum cleaner with respect to the mobile base, the powered cleaning device, and the conduit structure.

Device 18 comprises a beater bar 52, a conventional motor 54 and drive 56 operatively attached thereto, a nozzle 58 partially enclosing beater bar 52, and a housing 60 enclosing motor 54, drive 56 and nozzle 58. Beater bar 52 is in the form of an axially rotatable, elongated cylinder 62 having strips of alternately bristled 64 and solid 66 material attached to the periphery thereof. Motor 54 and drive 56 are operatively connected to bar 52 for driving rotation of the latter. Nozzle 58 is in the form of a hollow, tapered element 59 defining a passageway therewithin; the element is configured to present a lowermost rectangular opening 68 sized to receive beater bar 52, whereas the upper end of the element 52 includes an upright tube 70 which extends through deck aperture 48 as illustrated (see FIG. 2). In the usual fashion, beater bar 52 is supported within opening 68 in position for engaging the floor surface 14 during cleaning operations.

Front wheels 72 are mounted on forward transverse axle 74 attached to the opposed sidewalls 28, 30. A pair of spaced, rear castered wheels 76 are attached to the underside of a horizontally oriented, transverse, vertically shiftable mounting strip 78. Respective, depending, apertured ears 80, 82 are located at the opposed end of strip 78. Corresponding, elongated, forwardly extending struts 84, 86 are respectively pivotally secured to the ears, 80, 82 and to the adjacent sidewalls 28, 30. As may be readily seen, simultaneous pivoting of struts 84, 86 with respect to sidewalls 28, 30 produces a corresponding vertical movement of strip 78 and attached castered wheels 76.

An adjustment lever 88 is pivotally attached to the rear portion of deck 40. Lever 88 extends through a narrow, slit-like aperture 90 in deck 30 for engaging the upper surface of strip 78 and permitting vertical adjustment thereof. The strip-engaging underside of lever 88 presents a plurality of interconnected, straight surfaces **92*a*, 92*b* and 92*c*, each located a different distance from the pivot axis of the lever 88. As those skilled in the art will readily appreciate, rotation of lever 88 to successive positions wherein the surfaces 92*a*, 92*b*, and 92*c*, engage strip 778 serves to correspondingly change the vertical position of strip 78 and thereby castered wheels 76. Hence, manipulation of lever 88 effects height adjustments of the overall device 10**, so as to easily accommodate all types of floor surfaces encountered in operation.

Cleaner 11 is of conventional construction and includes a motor 98 and impeller 100 situated with respect to an inlet port 96 to produce negative pressure conditions at port 96. An elongated conduit 20 is fixidly secured to the uppermost portion of tube 70 and connects tube 70 to inlet port 96 in order to induce negative pressure conditions within nozzle 58 for vacuum cleaning of floor surface 14.

A U-shaped handle 94 is mounted on the rearward portion of deck 40.

Figure 4:
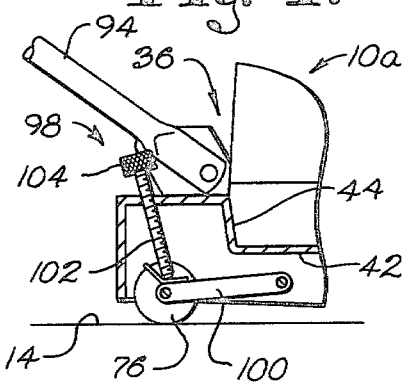
FIG. 4 is a fragmentary view in partial vertical section of another embodiment of the invention having a screw-type height adjustment.
Figure 3:
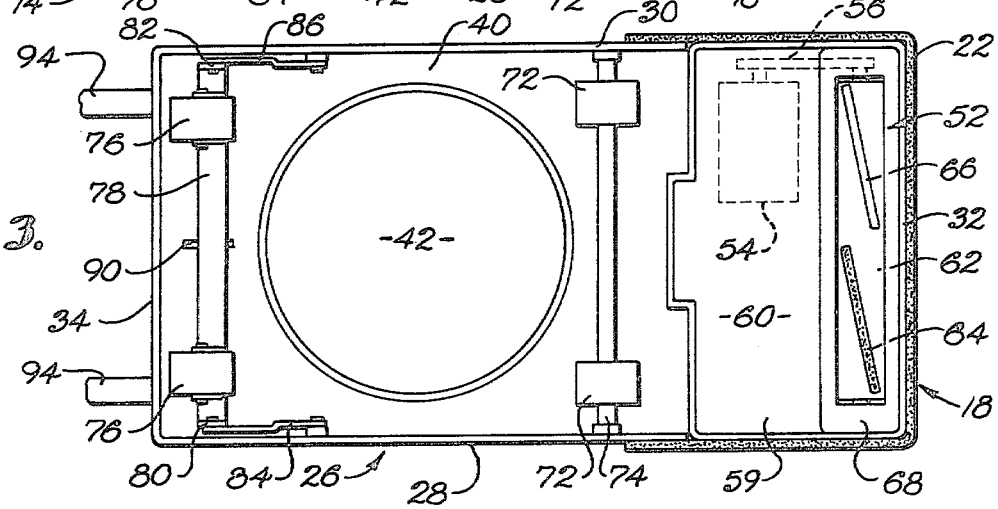
FIG. 3 is a bottom view of the conversion device in accordance with the invention.

In FIG. 4, a device **10*a* is illustrated which is in most respects identical with the first-described embodiment. However, the device 10*a* includes screw adjustment apparatus 98 which is different than that described above. Specifically, the apparatus 98 includes pivotal links 100 operatively coupled to the rear wheels 76, along with a central screw thread 102 having a knurled operating handle 104. As will be readily appreciated from a study of FIG. 4, rotation of screw 102 serves to correspondingly raise or lower the wheels 76, so as to adjust the effective height of the device 10*a*. In all other respects, the FIG. 4 embodiment is identical with that of FIGS. 1–3**.

In use, a cleaner 11 is placed in recess 16 of section 36. Conduit 20 is then attached to inlet port 96, thereby communicating cleaner 11 and nozzle 58. Adjustment lever 88 is rotated to adjust the height of device 18 to correspond to the particular floor surface 14 to be cleaned.

Cleaner 11 is then switched on, and the operator moves device 10 across floor surface 14 by means of handle 94.

Motor 54 and drive 56 cause beater bar 52 to rotate and contact with surface 14. The physical agitation of surface 14 produced by bar 52 loosens the dirt or the like thereon. Negative pressure conditions produced by motor 98 and impeller 100 of cleaner 11 allow vacuum removal of dirt or the like through nozzle 58 and attached conduit 20 into cleaner 11.

Device 10 allows the use of the powerful cannister cleaner 11 in the manner of a maneuverable and adjustable upright-type cleaner. The combination of a cannister cleaner and the device in accordance with this invention allows a consumer requiring the advantages of an upright-type cleaner to avoid the necessity of purchasing and having available both a cannister and an upright cleaner.

I claim:

1. A conversion device for a cannister vacuum cleaner, said cleaner including means defining an inlet opening, and means for creating negative pressure conditions at said inlet opening, comprising:

a mobile base having structure thereon for releasably supporting said cannister vacuum cleaner thereon;

a powered cleaning device including shiftable means for contacting a floor surface, and for loosening dirt or the like thereon;

motive means operatively connected to said shiftable means for operating the latter;

structure defining a passageway for vacuum removal of said dirt or the like from said floor surface;

means for mounting said cleaning device on said base in a position for cleaning of said floor surface; and conduit means for releasably and operatively connecting said passageway-defining structure and said inlet opening, when a cannister vacuum cleaner is supported on said base.

2. The conversion device as set forth in claim 1, including a plurality of wheels secured to said base.

3. The conversion device as set forth in claim 1, including shiftable means for adjusting the ground clearance height of said powered cleaning device.

4. The conversion device as set forth in claim 1, including handle means secured to said base.

5. The conversion device as set forth in claim 1, wherein said shiftable means comprises an elongated, axially rotatable cylinder having peripheral floor surface-engaging elements thereon.

6. The conversion device as set forth in claim 1, said base including walls defining a cannister-receiving recess.

7. The conversion device as set forth in claim 1, said device being mounted in front of said cannister-supporting structure.

* * * * *